United States Patent [19]

Högner

[11] 4,054,274

[45] Oct. 18, 1977

[54] METHOD AND APPARATUS FOR AVOIDING THE EMISSION OF CARBON MONOXIDE FROM CONVERTER EXHAUST GASES

[75] Inventor: Winfried Högner, Oberhausen, Germany

[73] Assignee: Gutehoffnungshutte Sterkrade Aktiengesellschaft, Germany

[21] Appl. No.: 689,852

[22] Filed: May 25, 1976

[30] Foreign Application Priority Data

June 7, 1975 Germany ..... 2525427

[51] Int. Cl.[2] ..... C21C 5/40

[52] U.S. Cl. ..... 266/80; 266/158

[58] Field of Search ..... 75/60; 266/78, 80, 157, 266/158

[56] References Cited

U.S. PATENT DOCUMENTS 3,357,820 12/1967 Rasworschegg et al. ..... 266/158 X

*Primary Examiner*—Gerald A. Dost

*Attorney, Agent, or Firm*—McGlew and Tuttle

[57] ABSTRACT

A method of avoiding emission of carbon monoxide from the exhaust gases of oxygen converters comprises collecting the gases of the converter in a cooling stack and directing the gases from the cooling stack through a dust collector to a clean gas stack in which they are permitted to flow out through the top and preferably through a burning device for burning them off. To insure that the gases remain burnable an additional fuel gas is fed into the clean gas stack for combining with the other gases and in quantities which are proportional to the content of carbon monoxide and oxygen in the gases which are circulated. An apparatus for carrying out the method includes a connection between a cooling gas stack in which the gases are collected from the converter to a clean gas stack which includes a dust collector and a blower for circulating the gases. Sensing means are provided preferably before the dust collector for sensing the carbon monoxide concentration and before the circulating blower for sensing the oxygen concentration and these sensing parameters are used to control a valve for the admission of separate fuel gas into the clean gas stack for combining with the other gases so that they may be burned to the top of the clean gas stack in a torch burn off device.

3 Claims, 3 Drawing Figures

METHOD AND APPARATUS FOR AVOIDING THE EMISSION OF CARBON MONOXIDE FROM CONVERTER EXHAUST GASES

BACKGROUND OF THE INVENTION

1. Field of the Invention

This invention relates in general to a method and apparatus for treating the gases of industrial processes such as the emissions of metallurgical converters and in particular to a new and useful method and apparatus for avoiding the emission of carbon monoxide from converter exhaust gases.

2. Description of the Prior Art

The present invention is particularly concerned with the elimination of carbon monoxide and emissions of industrial gases and particularly the gases generated by oxygen converters employed in metallurgical plants. In such plants it is known that the carbon monoxide emissions appear particularly at the beginning and at the end of the blasting period. This is due to the low carbon monoxide concentrations and the fact that the exhaust gas cannot be burnt in this range at the outlet of a pure gas stack through which the gases are passed and that the gases cannot be stored. Methods for the controlled exhaust of converter exhaust gases with reduced combustion or without any combustion are known and also methods are known for the subsequent storage of the exhaust gases outside of the operating region. In such cases the carbon monoxide is naturally preserved. The problem of its elimination has thus not been solved.

SUMMARY OF THE INVENTION

The invention provides a method and a device for making the non-combustible converter exhaust gases which appear at the beginning and the end of the blasting period in converter operation due to the low carbon monoxide concentration, combustible.

It was found that such a method according to the invention can be provided if a combustible gases or gas mixture such as a coke oven gas, a natural gas or a stored converter gas containing carbon monoxide in a combustible concentration is added under controlled conditions to the converter gas which contains less than 30% by volume of carbon monoxide and less than 5% by volume of oxygen and that after addition of the gas the mixture is burnt.

The invention provides a device for avoiding the emission of carbon monoxide from the exhaust gases of oxygen converters especially where the carbon monoxide is present in a non-combustible concentration. The device includes a cooling stack for entraining the gases from the converter and for circulating the gases after passage through a dust collector to a clean gas stack for emission to the atmosphere. The connection contains a carbon monoxide concentration meter and an oxygen concentration meter located adjacent a blower for circulating the gases. The clean gas stack contains a burn off device which is arranged adjacent the top thereof which the gases are circulated. The fuel gas feed line is connected into the clean gas stack and fuel gas is fed into the clean gas stack in accordance with the sensed values of carbon monoxide and oxygen in the gases which are circulated. The valve for controlling the amount of fuel gas is regulated in accordance with the oxygen content and carbon monoxide content of the gases collected from the converter and passed through a dust collector. With the method of the invention the non-combustible exhaust gas is enriched at the beginning and at the end of the blast period either by a combustible foreign gas such as coke oven gas or by a natural gas or by the converter exhaust gas obtained from preceding charges.

Without enrichment, the carbon monoxide content starts at the beginning of the blast period at a 0% by volume and increases into a combustible range of the converter gas at about 30% by volume. This process takes place in reverse order at the end of the blast period. In order to avoid explosions, the enrichment is controlled according to the invention in dependence on the oxygen content of the exhaust gas and the enrichment is only effected when the oxygen content in the exhaust gas is under 5% by volume. An oxygen sensing device is therefore arranged directly ahead of the blower for circulating the gases in order to be able to detect leaks in the preceding system.

Accordingly it is an object of the invention to provide a method of burning gases collected from an oxygen converter which comprises sensing the carbon monoxide and oxygen contents of the gases which are passed after collection from a cooling stack to a clean gas stack and by adding a fuel gas into the clean gas stack in accordance with the carbon monoxide and oxygen values sensed in order to provide a combustible mixture for burn off during emission from the clean gas stack.

A further object of the invention is to provide an apparatus for treating gases of an oxygen converter which comprises a cooling stack arranged over the converter in a position to collect the gases therefrom, a clean gas stack having an upper end with a burn off device and a connection conduit extending between the cooling stack and the clean gas stack which includes a dust collector and means for circulating the gas and including means for directing a fuel gas into the clean gas stack and for sensing the oxygen content and the carbon monoxide in the connection between the cooling stack and the clean gas stack and for controlling the flow of the fuel gas into the stack in proportion to the oxygen content and carbon monoxide which are sensed.

A further object of the invention is to provide an apparatus for avoiding the emission of carbon monoxide from gases collected from an oxygen converter which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawings and descriptive matter in which there are illustrated preferred embodiments of the invention.

GENERAL DESCRIPTION OF THE PREFERRED EMBODIMENTS

Figure 1:
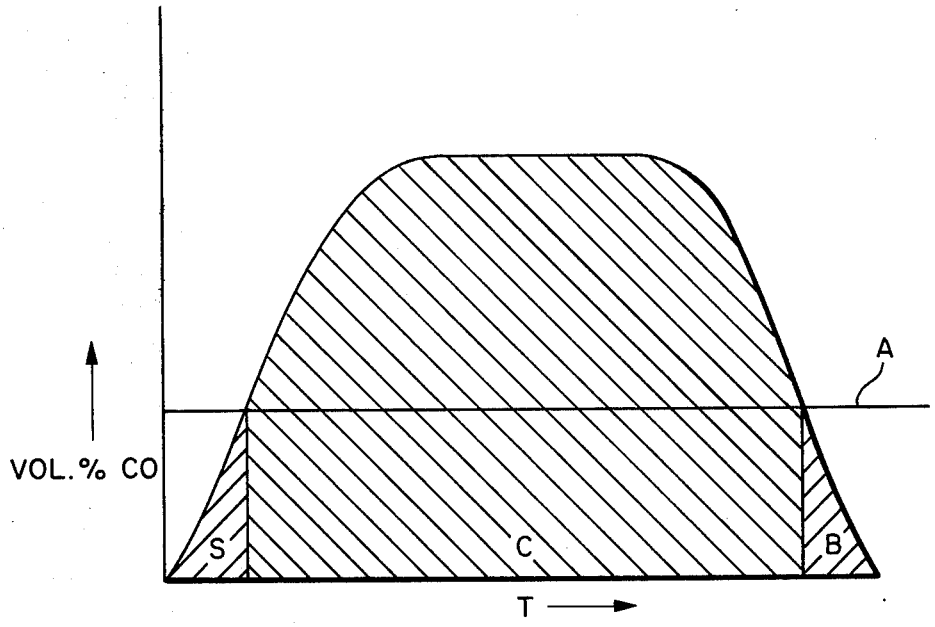
FIG. 1 is a curve representing the carbon monoxide content of gases which are emitted from an oxygen converter during the various stages of operation.
Figure 2:
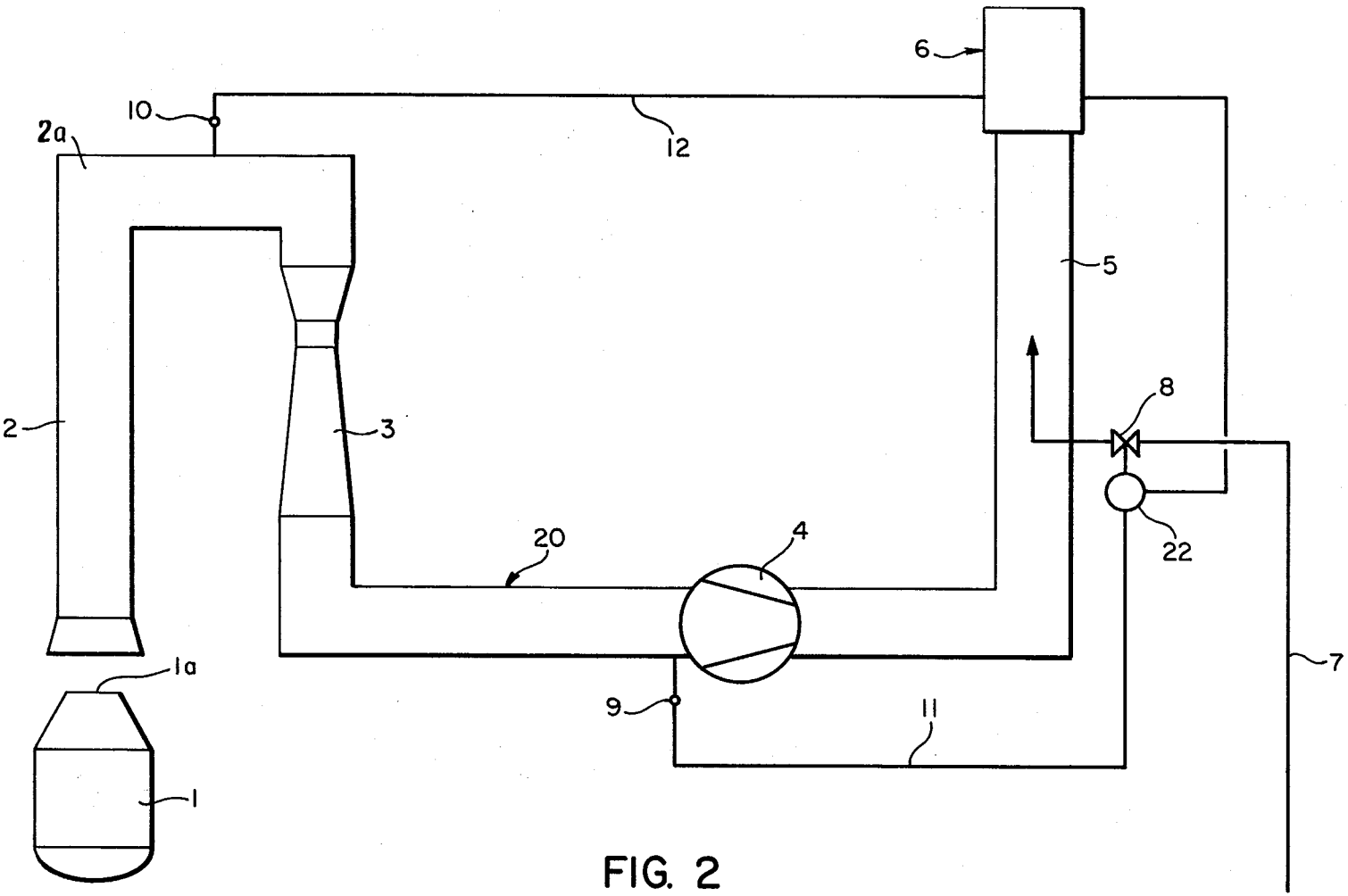
FIG. 2 is a schematic diagram of an apparatus for avoiding the emission of carbon monoxide from oxygen converter gas discharges.

Referring to the drawings in particular, FIG. 1 indicates a curve showing the variation of carbon monoxide in gases which are discharged from an oxygen converter during a cycle of blasting operations. The line A indicates a carbon monoxide concentration at which a gas mixture with carbon monoxide becomes combustible. The area B below the line indicates the region in which non-combustible carbon monoxide is emitted. The area C both above and below the line indicates the area in which the gas mixture is combustible or in which it would pay to store the gas for future combustion use. The area S is similar to the area B on the beginning of the cycle. In the embodiment of the invention shown in FIG. 2 a metallurgical blast furnace or an oxygen converter 1 is positioned directly beneath a cooling stack 2 which is disposed directly above the mouth 1*a* of the converter in a position to receive the gases therefrom. The gases are cooled in the cooling stack 2 and they are passed over and downwardly into a connection gas conduit generally designated 20 which is connected between the cooling gas stack 2 and a clean gas stack 5. The connection conduit 20 includes a dust collector 3 so that gases which pass upwardly through the cooling stack 2 flow through a portion 2*a* of the connecting conduit 20 and downwardly through a dust arrester 3 and then through a blower 4 which provides means for circulating the gas to the clean gas stack 5. The gas moves upwardly in clean gas stack 5 and passes through an opening which contains a burning off device generally designated 6 which may comprise a torch or other device for providing continuous ignition of any combustible gases exiting through the clean gas stack 5.

In accordance with the invention a fuel gas is fed through a fuel gas supply line 7 and is discharged directly into the clean gas stack 5. The quantity of fuel gas which is discharged is regulated by a control mechanism which includes a valve 8 which is operated by a control device 22 in response to quantities of carbon monoxide which is sensed by a sensor 10 in the passage 2*a* and quantities of oxygen which are sensed by a sensor 9 directly before the blower 4 in the conduit 20 to regulate the quantity of pure gas which is supplied into the clean gas stack 5. The control means is regulated so that the valve 8 opens automatically when the oxygen concentration indicated by the sensor 9 indicates an oxygen concentration under 5% by volume. The valve 8 opens at first widely or fully and then closes proportionally to the carbon monoxide concentration as sensed by the sensor 10 until a carbon monoxide content of about 30% by volume has been attained.

At the end of the blast period the regulating valve 8 opens proportionally to the quantity of carbon monoxide sensed by the sensor 10 and closes when an oxygen concentration as sensed by the sensor 9 of about 5% by volume has been reached. Sensor 10 is connected through a connecting cable 12 to the control means 22 which may include a motor to drive the valve 8. The sensor 9 is connected through an electrical connecting conduit 11 through the control means 22.

Figure 3:
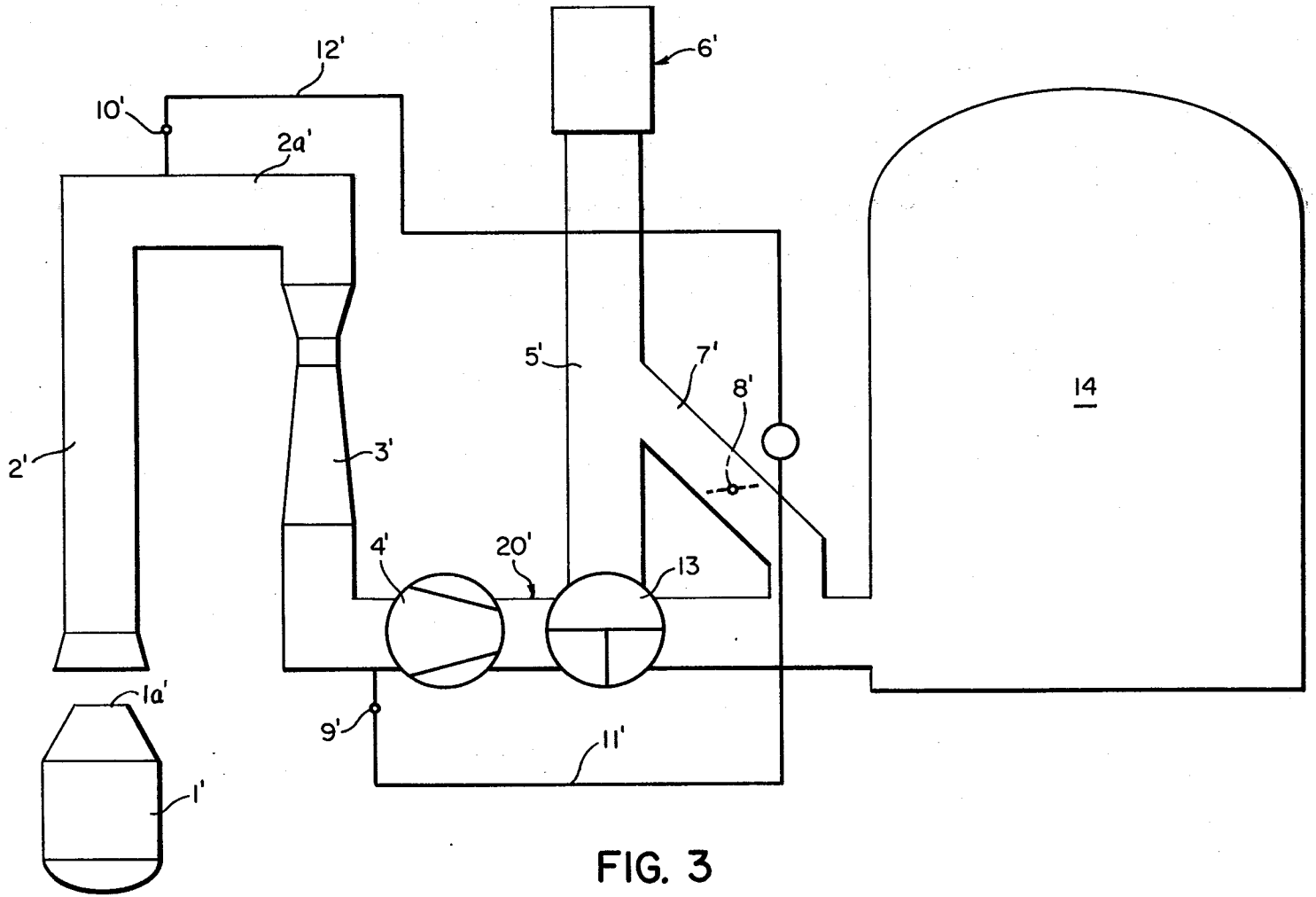
FIG. 3 is a view similar to FIG. 2 of another embodiment of the invention.

In the embodiment shown in FIG. 3 similar parts are similarly designated but with primes and in this embodiment a gas storage means in the form of a gasometer 14 provides a space for the storage of gases for example from other processes or from a previous cycle so that they may be used for enriching the gases in a clean air duct 5' so that they will burn readily in the burning device 6'. The gas which issues from the converter 1' flows upwardly in the cooling stack 2' and is purified in the dust arrester 3' in the connection conduit 20'. After the gas flows through the blower 4' it moves to a three way valve 13 from where it can be conducted either to the clean gas stack 5' and the burn off device 6' or to the gasometer or chamber 14. Between the three way valve 13 and the gasometer 14 is arranged a fuel gas pipe 7' which has a regulating valve or damper 8'. The stored gas in the gasometer 14 may be moved through the conduit 7' into the clean gas stack 5' in accordance with the setting of the valve 8'. Thus the gases convey during the beginning and the end of the blast period in order to increase the carbon monoxide content of the gases passing through the clean gas stack 5' so that they will burn in the burning device 6'. At the beginning of the blast period the regulating valve 8' opens automatically when the oxygen concentration sensed by the sensor 9' indicates an oxygen concentration of under 5% by volume. The valve 8' also opens at first widely and closed proportionally to the carbon monoxide concentration which is sensed by the sensor 10 until a carbon monoxide content of about 30% by volume has been attained. At the end of the blast period the regulating valve 8' opens proportionally to the quantity of the carbon monoxide sensed by the meter 10' and closed when the oxygen content had dropped to about 5% by volume.

In accordance with the method of the invention therefore the emission of carbon monoxide from the exhaust gases of an oxygen converter is prevented by collecting gases from the converter in a cooling stack and directing the gases from the cooling stack through a dust collector to a clean gas stack for emission therefrom at the upper end thereof while burning the burnable gases as they are emitted and including sensing the carbon monoxide content of the gases delivered to the clean gas stack as well as the oxygen content of the gases and adding a combustible gas into the clean gas whenever the sensed carbon monoxide level and oxygen level of the gases changes in respect to a predetermined acceptable level which requires the admission of a gas having combustible products with the gas in the clean gas stack. The method may be varied by storing the gases at a time when the carbon monoxide level and oxygen level are relatively high and then subsequently adding these to the subsequently emitted gases from the converter which are delivered to the clean gas stack. The method and device thus insure in a reliable manner that the emissions can be kept completely free of carbon monoxide even when the converter gases contain non combustible concentrations of the carbon monoxide.

While specific embodiments of the invention have been shown and described in detail to illustrate the application of the principles of the invention, it will be understood that the invention may be embodied otherwise without departing from such principles.

What is claimed is:

1. An apparatus for avoiding the emission of carbon monoxide from the exhaust gases of an oxygen converter, comprising a cooling gas stack adapted to be positioned over the converter to receive the gases discharged therefrom, a clean gas stack having a top opening for the emission of gas, a connection gas conduit between said cooling gas stack and said clean gas stack, a dust separator in said connection gas conduit, means for circulating gases from said cooling gas stack through said connection gas conduit to said clean gas stack, a separate fuel gas supply connection connected into said clean gas stack, means for sensing the oxygen content and the carbon monoxide content of gases passing through said connection gas conduit, and control means connected to said sensing means and said fuel gas supply connection to regulate the flow of fuel gas into said clean gas stack in accordance with the carbon monoxide and oxygen content of the gas which are sensed by said sensing means.

2. An apparatus according to claim 1, whereon said sensing means includes a carbon monoxide gas sensor located between said cooling gas stack and said dust separator and said oxygen sensor is located between said dust separator and said circulating means.

3. An apparatus according to claim 1, including a chamber for the storage of gases connected to said connection conduit, and valve means between said connection conduit, said chamber and said clean gas conduit for regulating the flow of gases from said connection conduit into said chamber during one phase of operation and for permitting the flow of gases from said chamber into said clean gas conduit during another phase of operation, said storage chamber having a connection into said clean gas conduits regulated by said control means.

* * * * *